US010791905B2

(12) United States Patent
Dries et al.

(10) Patent No.: US 10,791,905 B2
(45) Date of Patent: Oct. 6, 2020

(54) METHODS FOR DETERMINING OPERATION MODE OF DISHWASHER APPLIANCE FLUID CIRCULATION SYSTEM

(71) Applicant: Haier US Appliance Solutions, Inc., Wilmington, DE (US)

(72) Inventors: John Edward Dries, Louisville, KY (US); Kyle Edward Durham, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/270,670

(22) Filed: Feb. 8, 2019

(65) Prior Publication Data

US 2020/0253455 A1 Aug. 13, 2020

(51) Int. Cl.
*A47L 15/42* (2006.01)
*A47L 15/46* (2006.01)

(52) U.S. Cl.
CPC ..... *A47L 15/4208* (2013.01); *A47L 15/4221* (2013.01); *A47L 15/4289* (2013.01); *A47L 15/4297* (2013.01); *A47L 15/46* (2013.01); *A47L 2401/06* (2013.01); *A47L 2401/14* (2013.01)

(58) Field of Classification Search
CPC combination set(s) only.
See application file for complete search history.

(56) References Cited

U.S. PATENT DOCUMENTS

| | | | | |
|---|---|---|---|---|
| 9,649,006 | B2 | 5/2017 | Dries | |
| 9,763,552 | B2 | 9/2017 | Chapman et al. | |
| 9,795,271 | B2 | 10/2017 | Durham et al. | |
| 10,010,235 | B2 | 7/2018 | Gephart et al. | |
| 2010/0121497 | A1 | 5/2010 | Heisele et al. | |
| 2012/0291822 | A1* | 11/2012 | Tuller | A47L 15/4208 134/110 |
| 2013/0008477 | A1 | 1/2013 | Forst et al. | |
| 2016/0367106 | A1* | 12/2016 | Thiyagarajan | A47L 15/4221 |
| 2017/0079503 | A1* | 3/2017 | Dries | A47L 15/4208 |
| 2017/0172373 | A1 | 6/2017 | Gephart et al. | |

* cited by examiner

*Primary Examiner* — Erin F Bergner
(74) *Attorney, Agent, or Firm* — Dority & Manning, P. A.

(57) ABSTRACT

A method of determining a position of a diverter of a fluid circulation system in a dishwasher appliance includes measuring a fluid pressure in a sump of the dishwasher appliance while pumping fluid from the sump into a wash chamber of the dishwasher appliance via a first component when the diverter is in a first position. The method also includes measuring the fluid pressure in the sump of the dishwasher appliance while pumping the fluid from the sump to a filter cleaning manifold when the diverter is in a second position. Based on the measured fluid pressure, the method determines whether the diverter is in the second position.

20 Claims, 12 Drawing Sheets

METHODS FOR DETERMINING OPERATION MODE OF DISHWASHER APPLIANCE FLUID CIRCULATION SYSTEM

FIELD OF THE INVENTION

The subject matter of the present disclosure relates generally to dishwasher appliances, and more particularly to fluid circulation systems within dishwasher appliances and related methods.

BACKGROUND OF THE INVENTION

Dishwasher appliances generally include a tub that defines a wash compartment. Rack assemblies can be mounted within the wash chamber of the tub for receipt of articles for washing. Spray assemblies within the wash chamber can apply or direct wash fluid towards articles disposed within the rack assemblies in order to clean such articles. Multiple spray assemblies can be provided including, e.g., a lower spray arm assembly mounted to the tub at a bottom of the wash chamber, a mid-level spray arm assembly mounted to one of the rack assemblies, and/or an upper spray assembly mounted to the tub at a top of the wash chamber.

Dishwasher appliances further typically include a fluid circulation system which is in fluid communication with the spray assemblies for circulating fluid to the spray assemblies. Such fluid circulation systems generally include a filter and a pump downstream of the filter, e.g., the pump and the filter are positioned such that generally all wash fluid flowed to the pump is flowed through the filter. The fluid circulation system generally receives fluid from the wash chamber, filters soil from the fluid, and flows the filtered fluid to the spray assemblies. Additionally, unfiltered fluid can be flowed to a drain as required.

However, excess soil that remains on the filter can block such fluid flow. Accordingly, cleaning of the filter to prevent such blockages during operation is desired. One solution is to actively spray fluid at the filter to remove the soil therefrom. For example, the fluid circulation system may be operable in at least two modes, a wash mode where fluid is pumped into and through the wash compartment and a filter cleaning mode where fluid is sprayed onto the filter. The fluid circulation system may be selectively operable in one of the two or more various modes based at least in part on a position of a diverter. Typically, an electronic position sensor is included in the fluid circulation system to allow the dishwasher appliance, such as a controller thereof, to determine the position of the diverter and thereby determine which operating mode, e.g., wash mode or filter cleaning mode, is active.

However, such electronic position sensors may introduce additional complexity to the fluid circulation system. For example, multiple wires are typically routed to the position sensor, resulting in additional complexity and part count of the fluid circulation system than would otherwise be present, e.g. without the electronic position sensor. Moreover, such wires must also run outside of the wet portion of the dishwasher appliance, e.g., to the controller, creating potential leak points where the wiring passes through.

Accordingly, improved methods of operating a dishwasher appliance and/or determining a position of a diverter in a dishwashing appliance are desired. In particular, methods wherein the use of electronic position sensors is not required would be advantageous.

BRIEF DESCRIPTION OF THE INVENTION

Aspects and advantages of the invention will be set forth in part in the following description, or may be obvious from the description, or may be learned through practice of the invention.

In accordance with one embodiment, a method of operating a dishwasher appliance is provided. The dishwasher appliance includes a tub that defines a wash chamber and a sump positioned below the wash chamber to receive fluid from the wash chamber. The method includes circulating fluid through the wash chamber with a fluid circulation system. The fluid circulation system includes a pump, a filter upstream of the pump, and a diverter downstream of the pump. Circulating fluid through the wash chamber includes pumping fluid from the sump into the wash chamber via a first component when the diverter is in a first position. The method also includes cleaning the filter by pumping the fluid from the sump to a filter cleaning manifold when the diverter is in a second position. The method includes measuring a fluid pressure in the sump with a pressure sensor while circulating the fluid and cleaning the filter. The method further includes determining whether the diverter is in the second position based on the measured fluid pressure.

In accordance with another embodiment, a method of determining a position of a diverter of a fluid circulation system in a dishwasher appliance is provided. The method includes measuring a fluid pressure in a sump of the dishwasher appliance while pumping fluid from the sump into a wash chamber of the dishwasher appliance via a first component when the diverter is in a first position. The method also includes measuring the fluid pressure in the sump of the dishwasher appliance while pumping the fluid from the sump to a filter cleaning manifold when the diverter is in a second position. The method further includes determining whether the diverter is in the second position based on the measured fluid pressure.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention including the best mode thereof, directed to one of ordinary skill in the art, is set forth in the specification, which makes reference to the appended figures.

DETAILED DESCRIPTION OF THE INVENTION

Figure 1:
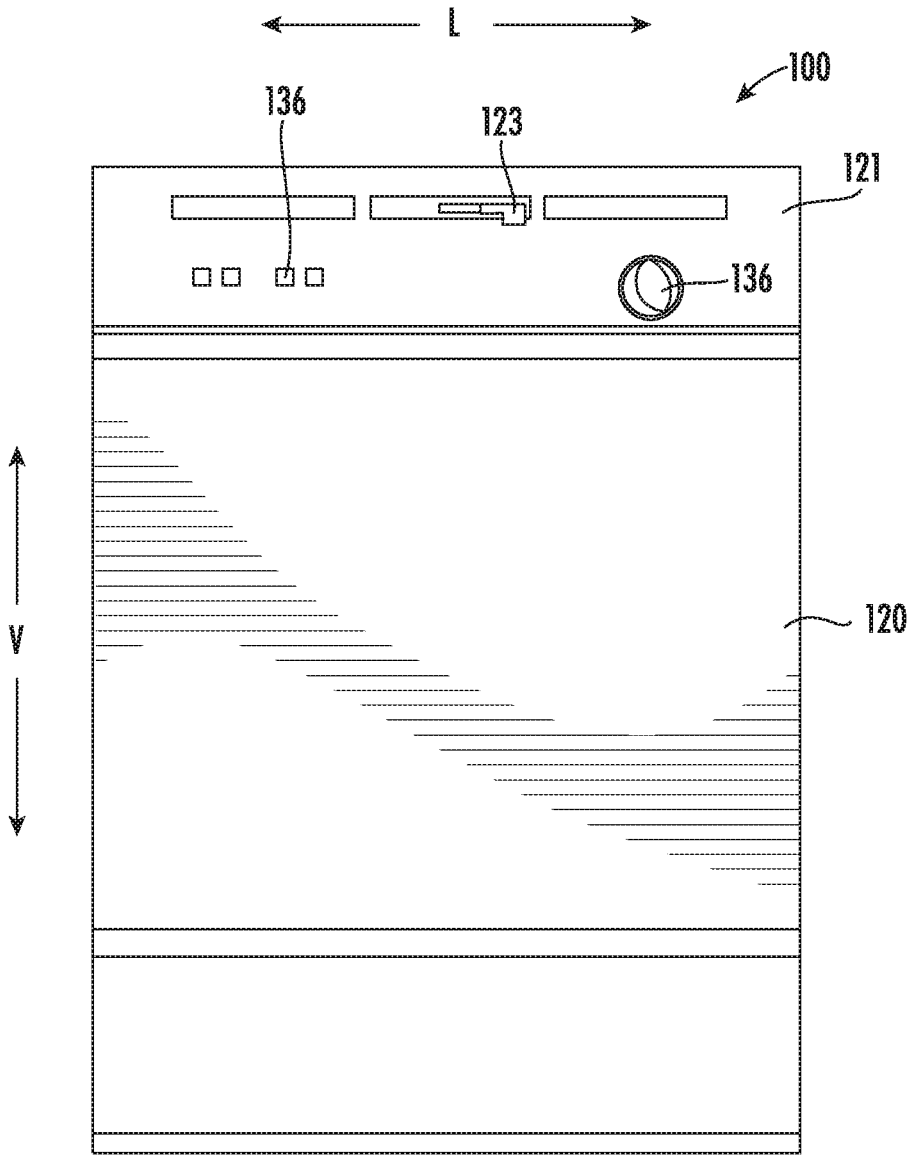
FIG. 1 provides a front view of a dishwasher appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to, dishes, pots, pans, silverware, and other cooking utensils and items that can be cleaned in a dishwashing appliance. The term "fluid" refers to a liquid used for washing and/or rinsing the articles and is typically made up of water that may include additives such as e.g., detergent or other treatments.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, the term "axially" refers to the relative direction that is substantially parallel and/or coaxially aligned to an axial centerline of a particular component and the term "circumferentially" refers to the relative direction that extends around the axial centerline of a particular component.

The terminology used herein is for the purpose of describing particular embodiments only and is not intended to be limiting. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
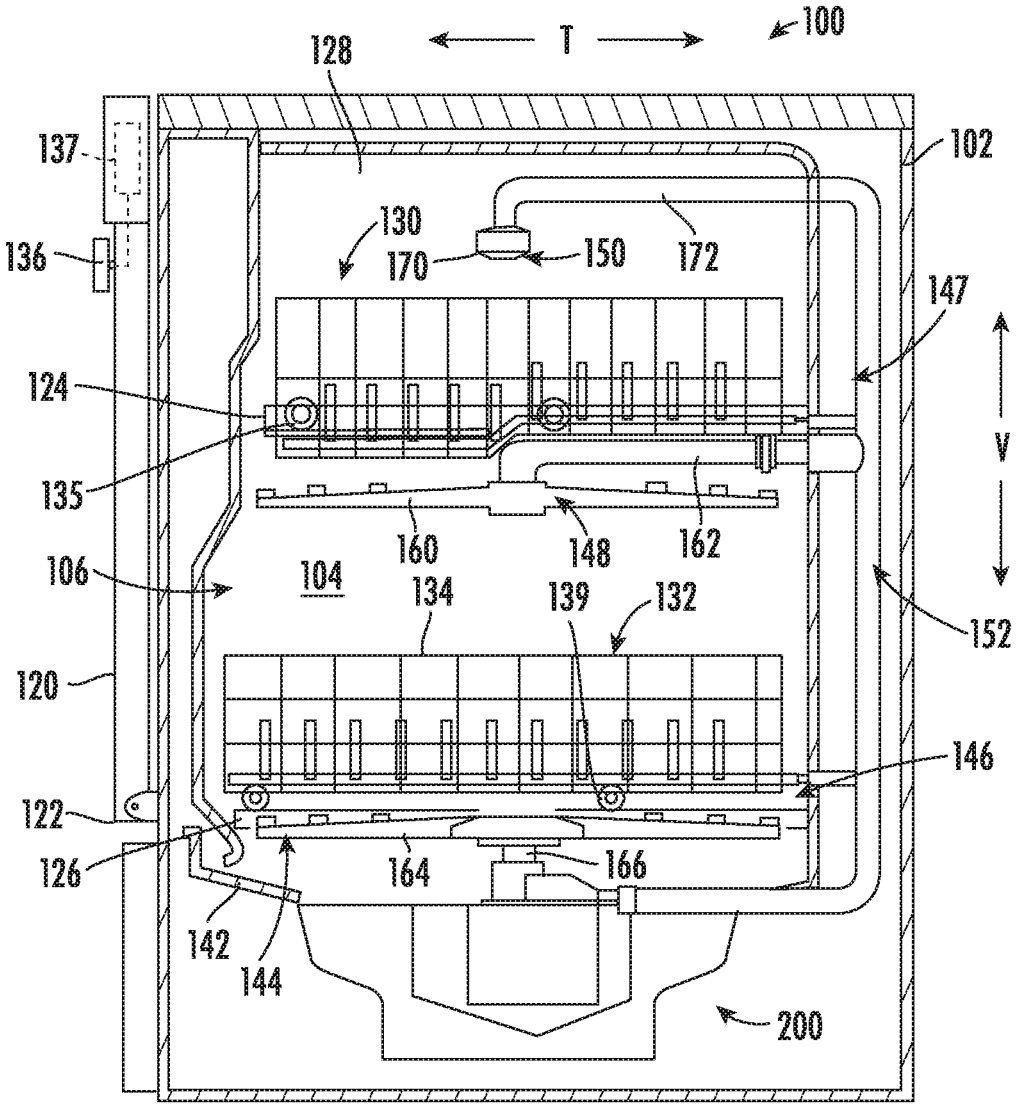
FIG. 2 provides a side, cross-sectional view of the dishwasher appliance of FIG. 1.

FIGS. 1 and 2 depict an exemplary domestic dishwasher appliance 100 that may be configured in accordance with aspects of the present disclosure. For the particular embodiment of FIGS. 1 and 2, the dishwasher appliance 100 includes a cabinet 102 having a tub 104 therein that defines a wash chamber 106. As shown, the dishwasher appliance 100 (such as the cabinet 102 thereof) defines a vertical direction V, a lateral direction L, and a transverse direction T, which are mutually orthogonal and define a coordinate system for the dishwasher appliance. The tub 104 includes a front opening (not shown) and a door 120 hinged at its bottom 122 for movement between a normally closed vertical position (shown in FIGS. 1 and 2), wherein the wash chamber 106 is sealed shut for washing operation, and a horizontal open position for loading and unloading of articles from the dishwasher. A latch 123 may be used to lock and unlock door 120 for access to chamber 106.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher appliance 100 further includes a lower spray-arm assembly 144 that is rotatably mounted within a lower region 146 of the wash chamber 106 and above a bottom wall 142 of the tub 104 so as to rotate in relatively close proximity to rack assembly 132. A mid-level spray-arm assembly 148 is located in an upper region 147 of the wash chamber 106 and may be located in close proximity to upper rack 130. Additionally, an upper spray assembly 150 may be located above the upper rack 130.

Each spray assembly 144, 148, 150 may include a spray arm or other sprayer and a conduit in fluid communication with the sprayer. For example, mid-level spray-arm assembly 148 may include a spray arm 160 and a conduit 162. Lower spray-arm assembly 144 may include a spray arm 164 and a conduit 166. Additionally, upper spray assembly 150 may include a spray head 170 and a conduit 172 in fluid communication with the spray head 170. Each spray assembly 144, 148, 150 includes an arrangement of discharge ports or orifices for directing washing liquid received from diverter 300 (See, e.g., FIGS. 3-5) onto dishes or other articles located in rack assemblies 130 and 132. The arrangement of the discharge ports in spray-arm assemblies 144 and 148 provides a rotational force by virtue of washing fluid flowing through the discharge ports. The resultant rotation of the spray-arm assemblies 144 and 148 and the operation thereof using fluid from diverter 300 provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc.

The lower and mid-level spray-arm assemblies 144, 148 and the upper spray assembly 150 are part of a fluid circulation system 152 for circulating fluid in the dishwasher appliance 100. The fluid circulation system 152 also includes various components for receiving fluid from the wash chamber 106, filtering the fluid, and flowing the fluid to the various spray assemblies such as the lower and mid-level spray-arm assemblies 144, 148 and the upper spray assembly 150.

Each spray assembly 144, 148, 150 may receive an independent stream of fluid, may be stationary, and/or may be configured to rotate in one or both directions. For example, a single spray arm may have multiple sets of discharge ports, each set receiving wash fluid from a different fluid conduit, and each set being configured to spray in opposite directions and impart opposite rotational forces on the spray arm. In order to avoid stalling the rotation of such a spray arm, wash fluid is typically only supplied to one of the sets of discharge ports at a time.

The dishwasher appliance 100 is further equipped with a controller 137 to regulate operation of the dishwasher appliance 100. The controller may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher appliance 100. In the illustrated embodiment, the controller 137 may be located within a control panel area 121 of door 120 as shown in FIGS. 1 and 2. In such an embodiment, input/output ("I/O") signals may be routed between the control system and various operational components of dishwasher 100 along wiring harnesses that may be routed through the bottom 122 of door 120. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses. It should be noted that controllers 137 as disclosed herein are capable of and may be operable to perform any methods and associated method steps as disclosed herein.

It should be appreciated that the invention is not limited to any particular style, model, or configuration of dishwasher. The exemplary embodiment depicted in FIGS. 1 and 2 is for illustrative purposes only. For example, different locations may be provided for user interface 136, different configurations may be provided for racks 130, 132, different combinations of spray assemblies may be utilized, and other differences may be applied as well.

Figure 3:
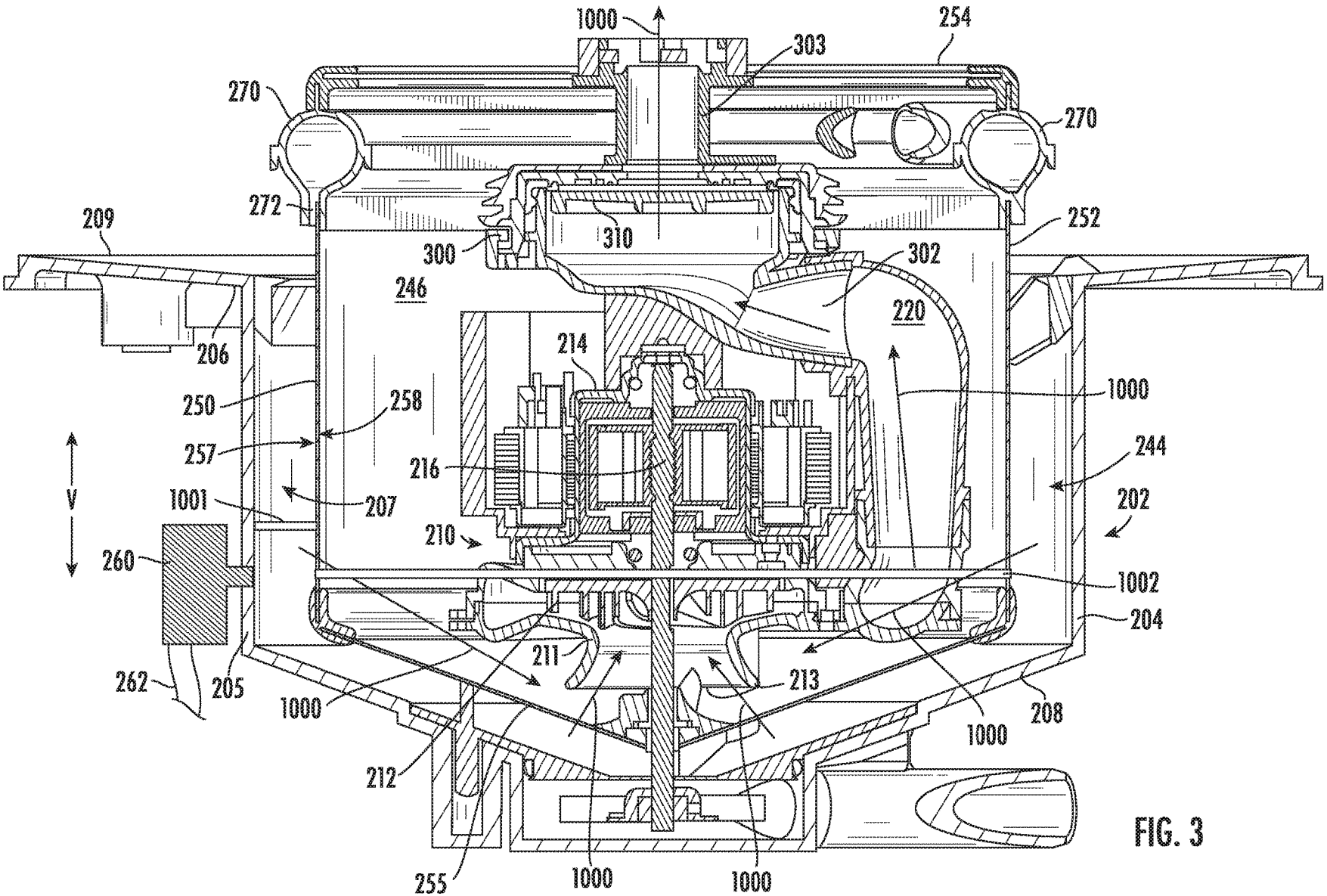
FIG. 3 provides a cross-sectional view of a fluid circulation system for a dishwasher appliance with a diverter in a first position in accordance with one embodiment of the present disclosure.
Figure 4:
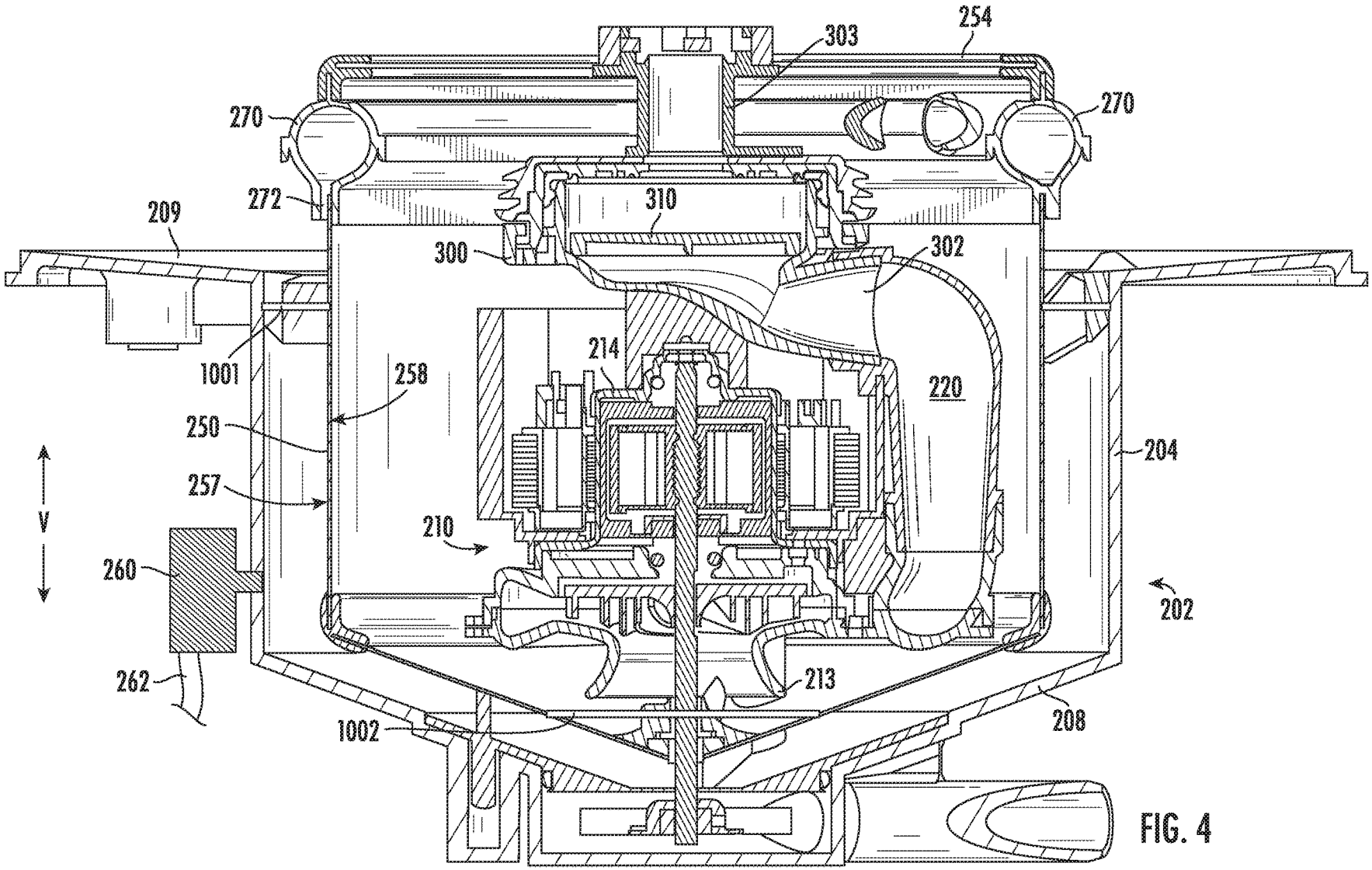
FIG. 4 provides a cross-sectional view of the fluid circulation system of FIG. 3 with the diverter in a second position.
Figure 5:
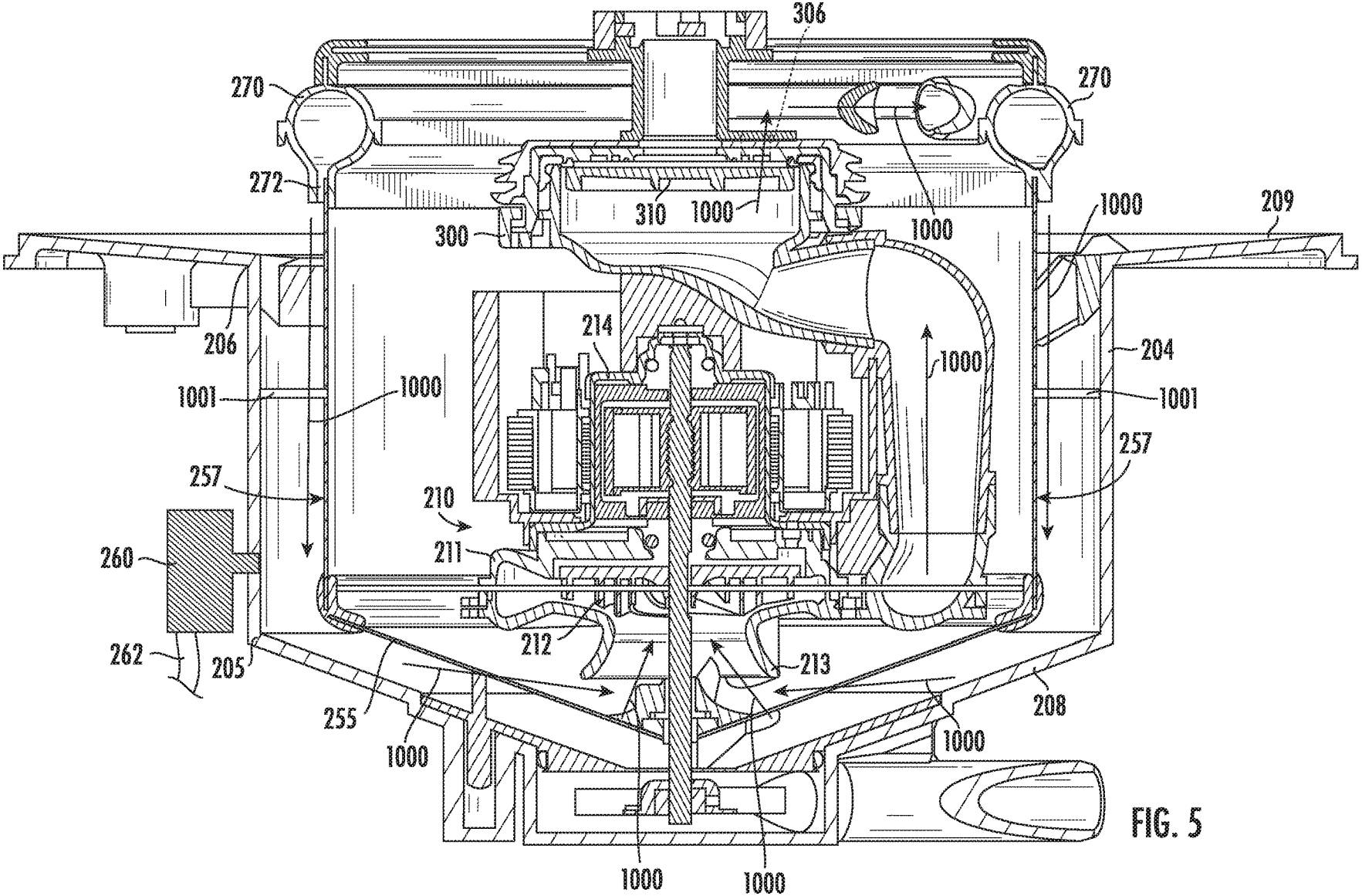
FIG. 5 provides a cross-sectional view of the fluid circulation system of FIG. 3 with the diverter in a third position.

Referring now to FIGS. 3 through 5, embodiments of portions of the fluid circulation system 152 of a dishwasher appliance 100 are illustrated. As shown, system 152 may include, for example, a sump 200 (shown in FIG. 2) for receiving fluid from the wash chamber 106. The sump 200 may be mounted to the bottom wall 142 and fluid may for example flow from the bottom wall 142 into the sump 200. Sump 200 may include and define, for example, a chamber 202 which receives the fluid from the wash chamber 106. As illustrated, sump 200 may include a sidewall 204 and a base wall 208 which define the chamber 202. For example, an inner surface 207 of the sidewall 204 may partially define the chamber 202. The sidewall 204 may extend from the base wall 208, such as generally along the vertical direction V. As mentioned above, "generally" in the context of an angle or direction means within ten degrees, e.g., generally along the vertical direction may include within ten degrees of vertical. In some embodiments, the sidewall 204 may have a generally circular cross-sectional shape. Alternatively, the sidewall 204 may have a generally rectangular or other suitable polygonal cross-sectional shape, with multiple linear or curvilinear portions. Sidewall 204 may extend between a bottom end 205 (which may be connected to the base wall 208) and a top end 206 (which may be spaced from the base wall 208 along the vertical direction V).

Sump 200 may additionally include a skirt 209. The skirt 209 may extend from the sidewall 204, such as from the top end 206, away from the chamber 202 and away from a filter 250 disposed at least partially within the chamber 202 (as discussed herein). For example, the skirt 209 may extend generally perpendicularly to sidewall 204 and/or generally radially from the sidewall 204. As noted above, generally perpendicular is understood to include forming an angle within ten degrees of perpendicular, e.g., from eighty degrees to one hundred degrees, similarly, generally radial includes within ten degrees of radial. Fluid flowing into the chamber 202 may flow along skirt 209 until the skirt 209 reaches the sidewall 204, and the fluid may then flow into the chamber 202. Skirt 209 may, for example, be mounted to bottom wall 142.

System 152 may further include a pump 210 which provides pressurized fluid flow to a diverter 300 via a conduit 220. Pump 210 may include an impeller 212 which is disposed within the chamber 202. In some embodiments, the impeller 212 may be enclosed within a housing 211, and the housing 211 may include an intake 213 for drawing fluid into pump 210, e.g., to the impeller 212. Pump 210 may further include a motor 214 and a shaft 216 which connects the motor 214 and impeller 212. For example, the motor 214 may be disposed within the chamber 202, and may be hermetically sealed to prevent damage thereto from fluids within the chamber 202. Alternatively, the shaft 216 may extend through the base wall 208, and the motor 214 may be external to the chamber 202. Impeller 212 may spin within the chamber 202 when activated by the motor 214 to influence the flow of fluid within the chamber 202.

As further illustrated, a filter 250 may be disposed at least partially within the chamber 202. As shown, the filter 250 surrounds the impeller 212, and can additionally surround other components of the pump 210 such as the motor 214. As illustrated, a filter 250 in accordance with the present disclosure may include a sidewall 252. Filter 250 may further include a top wall 254. Still further, filter 250 may include a base wall 255. The sidewall 252 may extend generally along the vertical direction V, e.g., within 10 degrees of vertical, and between the top wall 254 and bottom wall 255. Accordingly, the filter 250 may define an unfiltered volume 244 and a filtered volume 246 within the sump chamber 202. That is, the unfiltered volume 244 may be the portion of sump chamber 202 upstream of the filter 250 with respect to a primary flow direction and the filtered volume 246 may be the portion of sump chamber 202 downstream of the filter 250 with respect to the primary flow direction. Further, it is understood that the unfiltered volume 244 is unfiltered relative to the filter 250. In some embodiments, the sidewall 252 may have a generally circular cross-sectional shape. Alternatively, the sidewall 252 may have a generally rectangular or other suitable polygonal cross-sectional shape, with multiple linear or curvilinear portions.

The sidewall 252 may include a filter media defining an outer surface 257 and an inner surface 258 of the sidewall 252. Some embodiments may include filter media, e.g., screen or mesh, having pore or hole sizes in the range of about four thousandths (0.004 or $^{4}/_{1000}$) of an inch to about eighty thousandths (0.08 or $^{80}/_{1000}$) of an inch in diameter, or the pores may otherwise be sized and shaped to allow fluid flow therethrough, while preventing the flow of soil therethrough, thus filtering the fluid as the fluid flows into the filter 250 through the walls thereof.

As further illustrated, system 152 may further include a cleaning manifold 270. The cleaning manifold may be configured to provide fluid to the outer surface 257 of the filter sidewall 252 for cleaning of the sidewall 252. In particular, fluid flowing through the outlet conduit 220 may, as discussed herein below, be diverted to the manifold 270. The fluid in the manifold 270 may then flow from the manifold 270 towards and onto the outer surface 257. The flow of fluid onto and on the outer surface 257 may advantageously clean the sidewall 252 by dislodging and removing soil from the sidewall 252. In exemplary embodiments, the fluid exhausted from the cleaning manifold 270 may be exhausted in a plurality of streams, which may for example, be relatively high velocity jets of fluid, towards the outer surface 257. The fluid may, for example, be exhausted generally along the vertical direction V onto the outer surface 257, and may flow generally along the vertical direction V (e.g., generally parallel to the outer surface 257) to clean the sidewall 252.

Cleaning manifold 270 may be disposed proximate the outer surface 257, and may for example wrap around at least a portion of the perimeter of the sidewall 252. As illustrated, manifold 270 may for example contact the outer surface 257. Further, in exemplary embodiments, manifold 270 may be disposed proximate the top wall 254. A plurality of apertures 272 may be defined in the manifold 270 for flowing fluid therethrough. Each aperture 272 may be oriented to direct fluid exhausted therefrom towards the outer surface 257. For example, fluid exhausted from each aperture 272 may be flowed generally along the vertical direction V and along the outer surface 257.

System 152 may further include a diverter 300. Diverter 300 may be configured for selectively flowing fluid to the wash chamber 106 (such as via one or more of the spray assemblies) or to the cleaning manifold 270, depending on the position of the valve 310. Use of such a diverter 300 in accordance with the present disclosure may advantageously provide improved cleaning of the filter 250 without requiring an increase in water usage or an increase in energy usage or motor size. Such improved cleaning is provided by, for example, selective diversion of the fluid to the cleaning manifold 270 for periodic amounts of time to clean the filter 250, such as the sidewall 252 thereof, as needed. Further, the diverter 300 may advantageously only be utilized to divert fluid to the cleaning manifold 270 when cleaning is needed, and may automatically select between flowing fluid to the wash chamber 106 (such as via one or more of the spray assemblies) or to the cleaning manifold 270.

Figure 6:
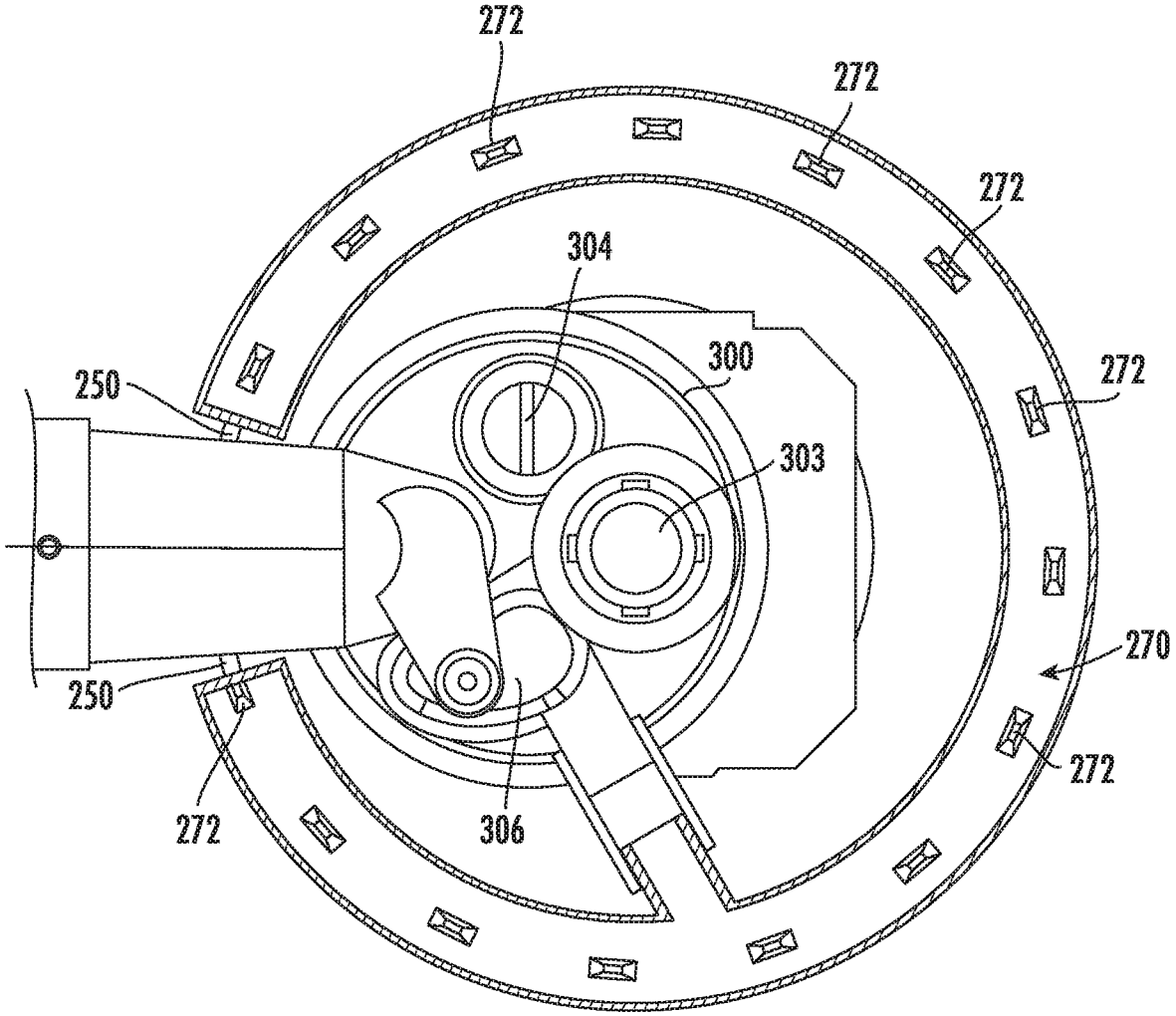
FIG. 6 provides a top-down sectional view of the fluid circulation system of FIG. 3.

FIG. 6 provides a top-down sectional view of the fluid circulation assembly 152, and in particular the filter cleaning manifold 270 thereof. As illustrated in FIG. 6, the plurality of apertures 272 may be spaced along a circumference of the filter cleaning manifold 270 above the filter 250. As indicated in the FIG. 6, the filter cleaning manifold 270 may be connected to a fourth outlet 306 of the diverter 300.

Figure 7:
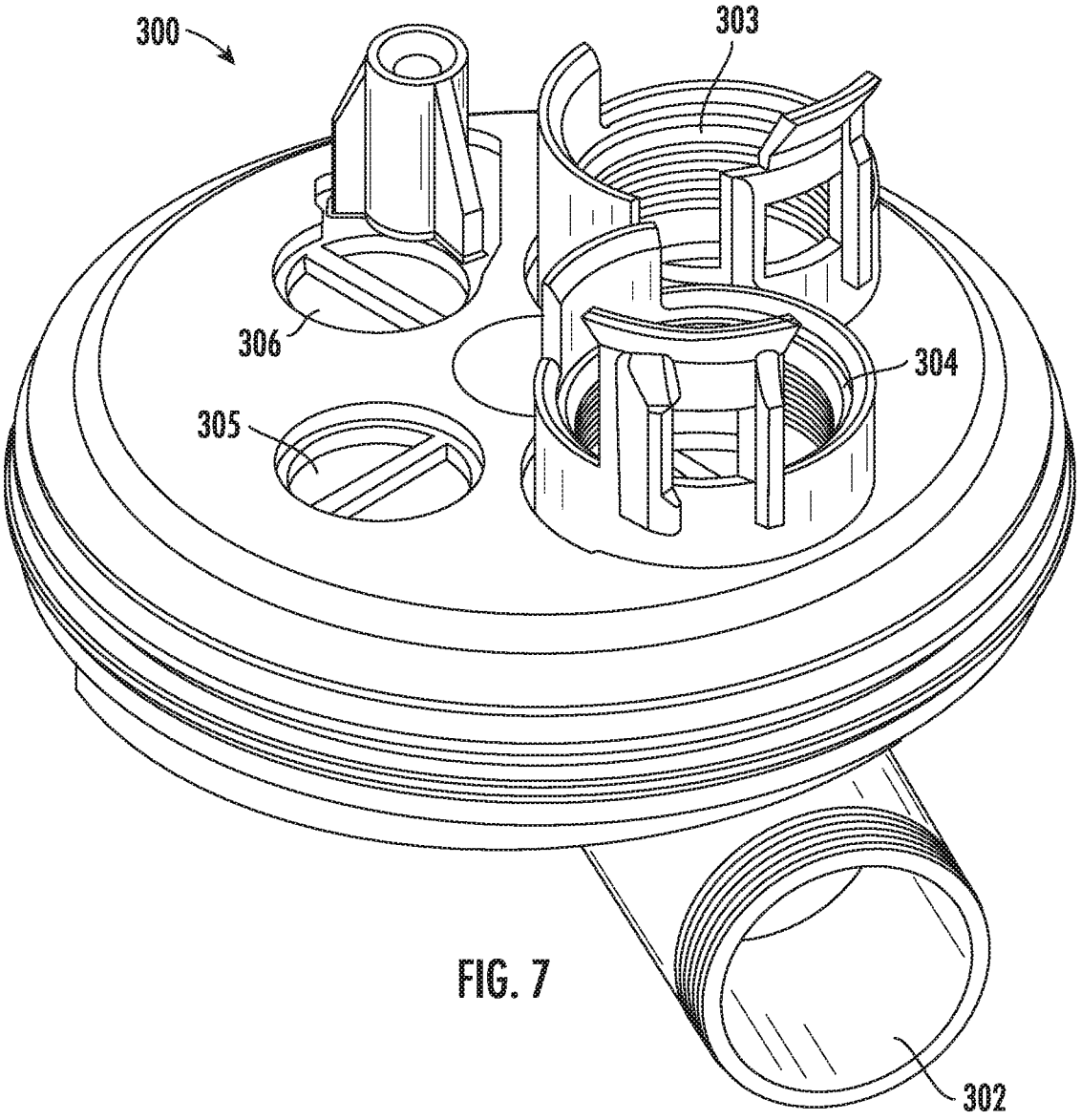
FIG. 7 provides a perspective view of a diverter according to an exemplary embodiment of the present disclosure.

As best seen in FIG. 7, an exemplary diverter 300 may include an inlet 302 in fluid communication with the pump 210, e.g., via conduit 220 (FIGS. 3-5), for receiving a flow of fluid from pump 210 that is to be supplied to spray assemblies 144, 148, and/or 150 or cleaning manifold 270, as well as other fluid-using components during cleaning operations. As stated, pump 210 receives fluid from, e.g., sump 200 and provides a fluid flow to diverter 300. The exemplary diverter 300 includes a plurality of outlets, e.g., as illustrated in FIG. 7, the diverter 300 may include four outlets, including first outlet 303, second outlet 304, third outlet 305, and fourth outlet 306. Diverter 300 includes a valve 310 (see, e.g., FIGS. 3-5), that can be selectively switched between outlets 303, 304, 305, and 306 by hydraulic actuation.

By way of example, first outlet 303 can be fluidly connected with upper spray assembly 150 and lower spray arm assembly 144 and second outlet 304 can be fluidly connected with mid-level spray arm assembly 148. Third outlet 305 may be fluidly connected with another fluid-using component, e.g., for cleaning silverware. Fourth outlet 306 may be fluidly connected to cleaning manifold 270. Other spray assemblies and connection configurations may be used as well. As such, the rotation of valve 310 in diverter 300 can be used to selectively place pump 210 in fluid communication with spray assemblies 144, 148, or 150, another fluid-using component, or cleaning manifold 270, by way of outlets 303, 304, 305, and 306. Thus, the dishwasher appliance 100 may be operable in various mode depending on the position of the diverter 300 and/or the valve 310 of the diverter 300, e.g., a wash mode when the valve 310 is positioned to divert fluid to one or more of the spray assemblies 144, 148, and/or 150, or a filter cleaning mode when the valve 310 is positioned to divert the fluid to the manifold 270.

In other embodiments of the invention, two, three, or more than four outlets may be provided in diverter 300 depending upon e.g., the number of switchable outlets desired for selectively placing pump 210 in fluid communication with different fluid-using elements of appliance 100. For example, in some embodiments, the plurality of outlets may include a first outlet and a second outlet, the second outlet in fluid communication with the cleaning manifold 270. In some embodiments, the first outlet may be in fluid communication with one or more spray assemblies 144, 148, and/or 150, such as lower spray arm assembly 144 and/or upper spray assembly 150. Also, some embodiments of the plurality of outlets may further include a third outlet in fluid communication with others of the spray assemblies 144, 148, and/or 150, such as mid-level spray arm 148. As used herein, the terms "first," "second," and "third" do not necessarily denote order or sequence, e.g., in the foregoing example embodiments, the diverter may be configured to provide flow to the third outlet before the second outlet.

Referring still to FIGS. 3 through 7, the diverter 300 may be configured to direct fluid from the pump 210 to the first outlet 303 in response to fluid pressure of the fluid from the pump 210 and to direct fluid from the pump 210 to another outlet, e.g., second outlet 304, in response to a change in the fluid pressure of the fluid from the pump 210. Thus, in at least some embodiments, the diverter 300 may be a passive diverter. For example, the diverter 300 may be actuated, e.g., moved between various positions to selectively provide fluid communication to one or more selected fluid-using components (such as spray assemblies), by the flow of fluid through the fluid circulation system 152 without a dedicated actuator such as a motor or other electrical or electronic actuator. For example, upon an initial activation of the appliance 100, e.g., at the initiation of a cleaning operation or cycle, the pump 210 may be activated, supplying fluid under pressure to the diverter 300, which may urge the diverter valve 310 to move upward along the vertical direction V and the valve 310 may also rotate as the valve 310 moves upward, such that an aperture (not shown) in the valve 310 may move into alignment with first outlet 303 as the valve 310 moves to or towards the top of the diverter 300. At a subsequent time, the pump 210 may be slowed or deactivated, such that the fluid pressure changes, e.g., decreases, such that the valve 310 returns to an initial, lower, vertical position while also rotating to an intermediate position, e.g., where the aperture (not shown) in the valve 310 is in between two adjacent outlets of the outlets 303, 304, 305, and 306. Such cycles, e.g., changes in pressure by speeding up or slowing down the pump, may be repeated and the valve 310 may move from one outlet to another at each repetition. For example, the pump 210 may be activated/deactivated and/or have its speed changed as in the foregoing description by the controller 137 according to a predetermined program or sequence of operations.

In interest of brevity, the exemplary diverter 300 is only described generally. For more detail, exemplary diverters are described in U.S. application Ser. No. 15/460,298 (U.S. 2018/0263458 A1) and U.S. application Ser. No. 15/470,963 (U.S. 2018/0279850 A1) both of John Edward Dries, both of which are incorporated herein by reference in their entirety.

Referring now specifically to FIG. 3, the diverter 300 may be positionable in a first position, where the valve 310 provides fluid communication to the first outlet 303 and from the first outlet 303 to a first component of the dishwasher appliance 100, e.g., one of the spray assemblies 144, 148, or 150 shown in FIG. 2. Thus, as indicated by arrows 1000 in FIG. 3, wash fluid may flow through the chamber 202 of the sump 200 from the unfiltered volume 244 to the filtered volume 246 and into the housing 211 of the pump 210 via the inlet 213. With the valve 310 positioned as shown in FIG. 3, e.g., when the dishwasher appliance 100 is in a cleaning mode, the flow of fluid through the sump 200 may be relatively rapid, such that a fluid level within the chamber 202 may be relatively low as the fluid is quickly drawn down by the pump 210. The dishwashing appliance 100 may include a pressure sensor, e.g., a pressure transducer 260, positioned outside of the sump 200 and configured to measure a pressure within the chamber 202 of the sump, e.g., corresponding to a fluid level within the sump 200. For example, more than one fluid level may, in some embodiments, be found within the chamber 200, e.g., a first fluid level 1001 within the unfiltered volume 244 and a second fluid level 1002 within the filtered volume 246. In other embodiments, only one fluid level may be present in the chamber 202. The pressure sensor 260 may be configured to sense or measure a pressure corresponding to the first fluid level 1001. For example, the pressure sensor may be positioned proximate the bottom end 205 of the sidewall 204 to measure a pressure generally corresponding to a height of the fluid between the bottom end 205 and the top end 206. One or more wires 262 may extend from the pressure sensor 260, e.g., to the controller 137. When the pressure sensor 260 is positioned outside of the sump 200 as shown, the wires 262 do not need to extend through a wall, e.g., one or both of the base wall 208 and sidewall 204, of the sump 200, thereby reducing possible leakage points by which fluid may escape from the sump 200.

Turning now to FIG. 4, when the fluid circulation system 152, e.g., the pump 210 thereof, is not active, the diverter valve 310 may move to a second position, e.g., by moving downward along the vertical direction V from the first position shown in FIG. 3 while also rotating about the vertical direction V. In such a non-circulation state or mode, the fluid level 1001 may be relatively higher than when the fluid circulation system 152 is actively circulating fluid within the dishwasher appliance 100, e.g., as may be seen by comparing FIGS. 3 and 4.

FIG. 5 illustrates a position of the diverter 300, e.g., of the valve 310 thereof, which corresponds to or indicates the dishwasher appliance 100 operating in a filter cleaning mode, wherein the fluid flowing from the pump 210 is directed to cleaning manifold 270 to clean the outer surface 257 of the filter 250, as described above. As indicated by arrows 1000 in FIG. 5, the diverter 300 may be in a third position where the fluid is directed to an outlet of the diverter 300 which is in fluid communication with the filter cleaning manifold 270, e.g., the fourth outlet 306, which is upstream of the filter cleaning manifold 270 and provides fluid communication to the filter cleaning manifold 270 from the pump 210. The fourth outlet 306 is indicated by dashed lines in FIG. 5 and may be best seen in FIGS. 6 and/or 7. As may be seen in FIG. 5, the fluid level 1001 within the chamber 202 may be higher when the dishwasher appliance 100 is in the filter cleaning mode than when the dishwasher appliance 100 is in the wash mode (FIG. 3). Accordingly, as may be seen, e.g., in FIG. 8, the corresponding pressure values obtained or measured by the pressure sensor 260 will be greater when the dishwasher appliance 100 is in the filter cleaning mode than when the dishwasher appliance 100 is in the wash mode.

Figure 8:
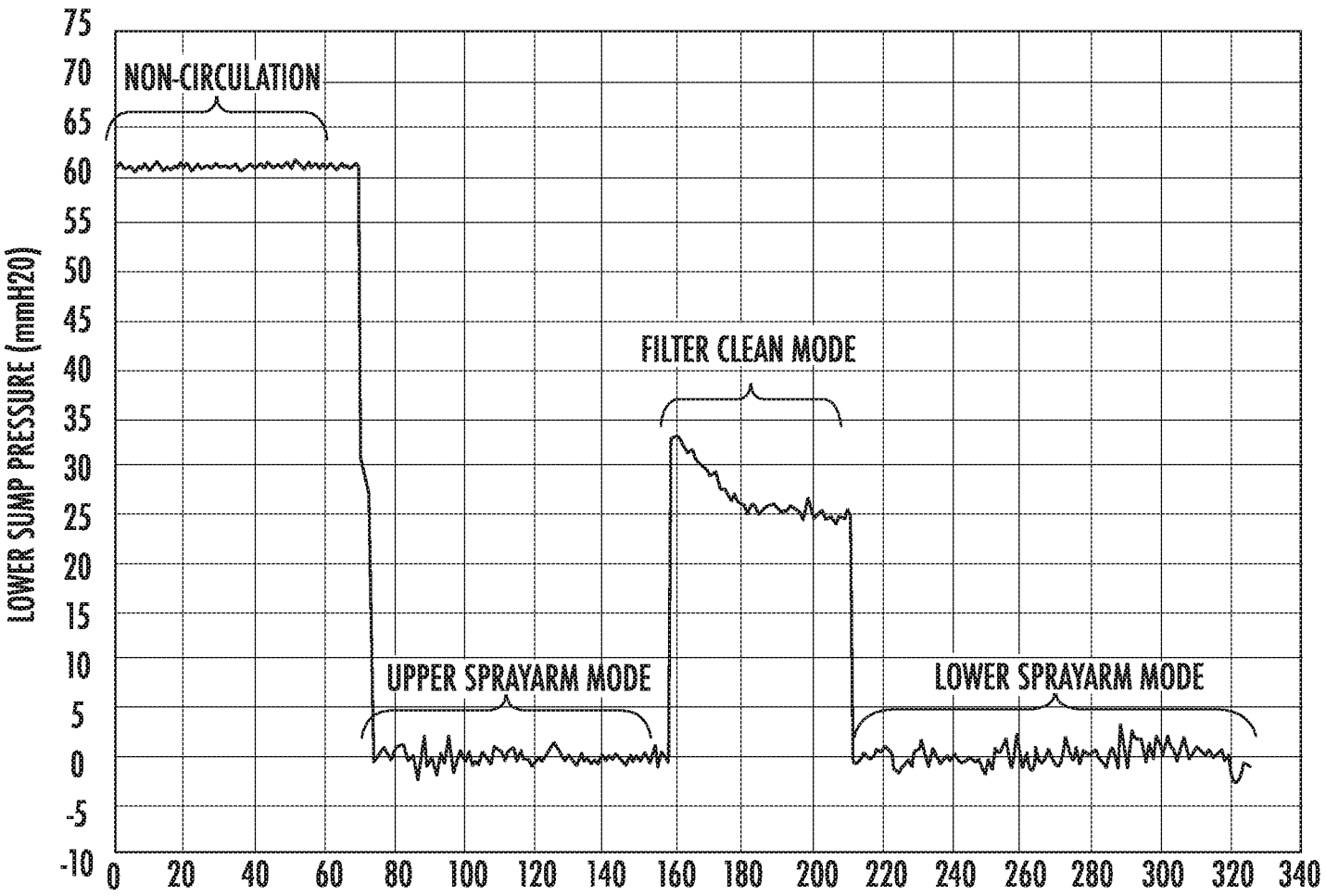
FIG. 8 provides a graph of exemplary measured pressure values which may be obtained during one or more exemplary methods according to the present disclosure.

FIG. 8 illustrates a graph of exemplary pressure values which may be measured or obtained by the pressure sensor 260 during various operational modes of the dishwasher appliance 100. In various embodiments, the pressure sensor 260 may measure or monitor the pressure within the sump 200. For example, the pressure sensor 260 may continuously measure the pressure and send the measured pressure values to the controller 137. As another example, the pressure monitor may periodically obtain measured pressure values, e.g., every second, every two or three seconds, or multiple times in a second. In the exemplary operation cycle depicted in FIG. 8, the dishwasher appliance 100 initially operates in a non-circulation mode, e.g., as illustrated in FIG. 4, followed by a first wash operation mode, a filter clean operation mode, and a second wash operation mode. Either or both of the first and second wash operation modes may be as illustrated in FIG. 3 and the filter clean mode may be as illustrated in FIG. 5. As may be seen for example in FIG. 8, the measured pressure values obtained during the filter clean mode are distinguishable from the pressure values corresponding to the non-circulation mode or the pressure values corresponding to the wash mode, e.g., where fluid is supplied to one or both of the upper spray arm 148 and the lower spray arm 144. In particular embodiments, the non-circulation operation mode may be determined or detected based on the status of the pump 210, e.g., when the pump 210 is inactive, it may be determined that the dishwasher appliance 100 is in a non-circulation state or mode. In such embodiments, when the pump 210 is active, the dishwasher appliance 100 is in either a wash mode (e.g., the fluid circulation system 152 is supplying fluid to one or more spray assemblies in the wash chamber 106) or a filter clean mode (e.g., the fluid circulation system is supplying fluid to the filter cleaning manifold 270), and the filter clean mode may be distinguished from the wash mode(s) when the measured pressure value increases.

Figure 9:
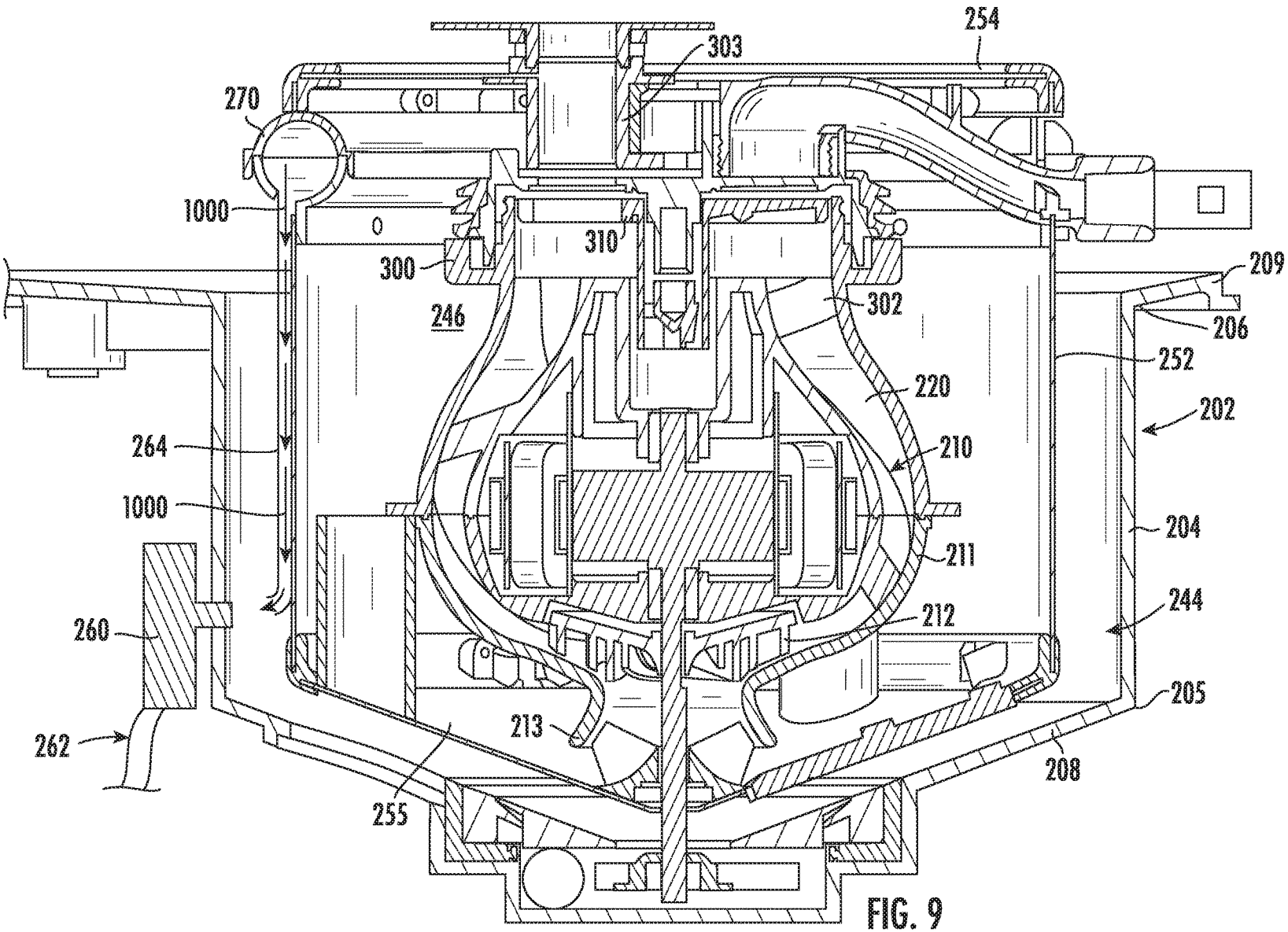
FIG. 9 provides a cross-sectional view of a fluid circulation system for a dishwasher appliance in accordance with another embodiment of the present disclosure.

In some embodiments, for example as illustrated in FIG. 9, the fluid circulation system 152 may include a conduit 264 extending from the filter cleaning manifold 270 to the pressure sensor 260. The optional conduit 264 may advantageously provide a higher pressure flow 1000 of fluid to the pressure sensor 260, e.g., as compared to other embodiments where the fluid flows across the filter 250 in a more diffuse manner before reaching the pressure sensor 260. Such flow may enhance or increase the distinction between pressure values measured during filter cleaning operation from pressure values measured during the wash operation. Additionally, the direct flow of fluid from the conduit 264 to the pressure sensor 260 may advantageously reduce or prevent fouling or clogging of the pressure sensor 260.

Figure 10:
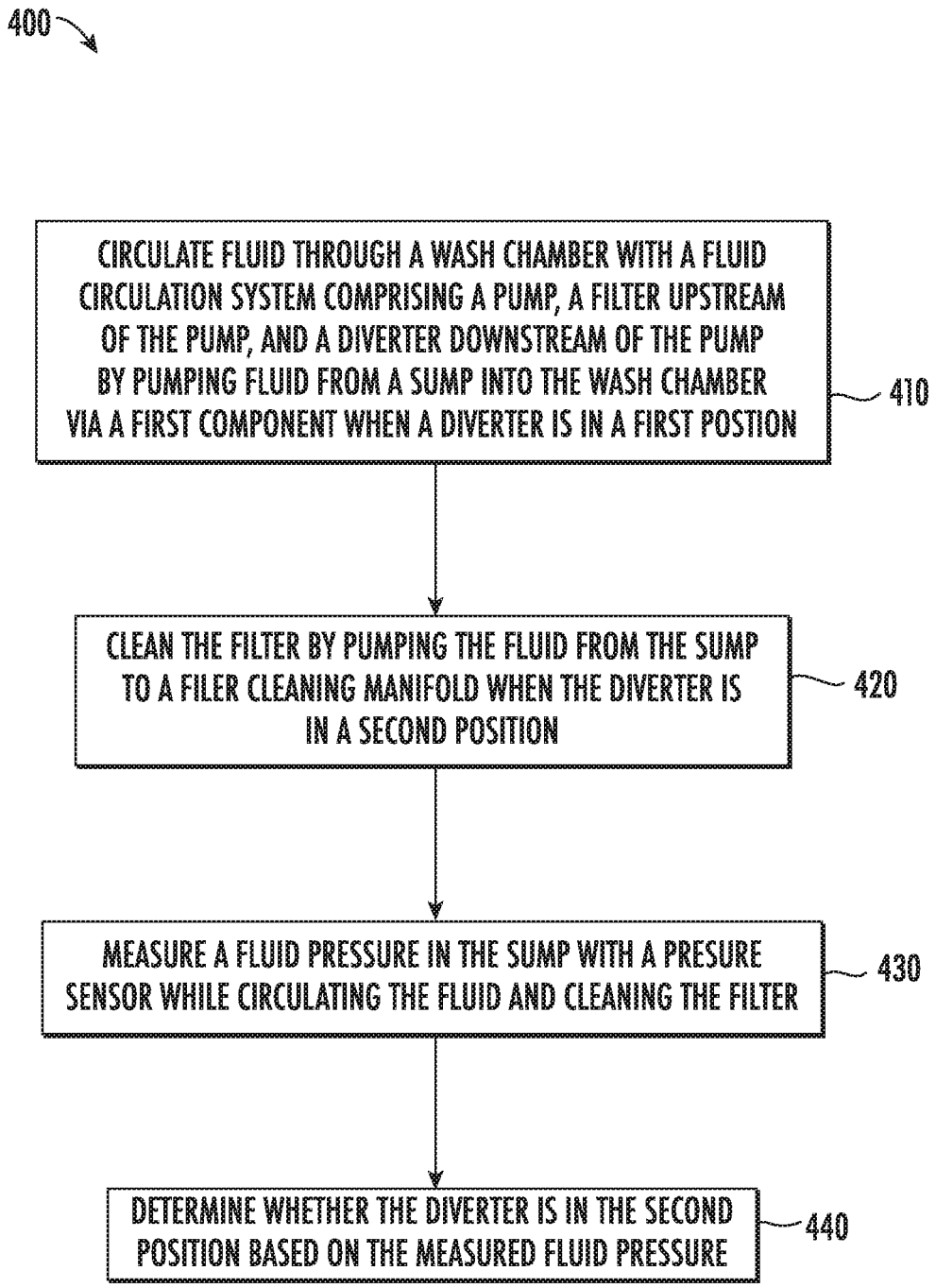
FIG. 10 provides a flowchart illustrating exemplary steps of a method according to one or more exemplary embodiments of the present subject matter.

FIG. 10 illustrates an example method 400 of operating a dishwasher appliance, such as the exemplary dishwasher appliance 100. For example, the dishwasher appliance may include a tub 104 that defines a wash chamber 106 and a sump 200 positioned below the wash chamber 106 to receive fluid from the wash chamber 106, as discussed above. The method 400 includes step 410 of circulating fluid through the wash chamber 106 with a fluid circulation system 152. In some embodiments, the fluid circulation system 152 may include a pump 210, a filter 250 upstream of the pump 210, and a diverter 300 downstream of the pump 210. Also, circulating fluid through the wash chamber 106 may include pumping fluid from the sump 200 into the wash chamber 106 via a first component when the diverter 300, e.g., a valve 310 of the diverter 300, is in a first position. For example, the first component may be one or more of the spray assemblies 144, 148, and 150 discussed above. The method 400 further includes a step 420 of cleaning the filter 250 by pumping the fluid from the sump 200 to a filter cleaning manifold 270 when the diverter 300 is in a second position. The method 400 also includes a step 430 of measuring a fluid pressure in the sump 200 with a pressure sensor 260 while circulating the fluid and cleaning the filter 250. As shown at step 440 in FIG. 10, the method 400 may also include determining whether the diverter 300 is in the second position based on the measured fluid pressure.

As discussed above, determining that the diverter 300 is in the second position may also include determining that the dishwashing appliance 100 is in a filter cleaning mode. Additionally, the second position may be referred to as a "home" position of the diverter 300 and the determination that the diverter 300 is in the home position may be, e.g., recorded or stored in a memory of the controller 137, and various other positions of the diverter 300 may be determined or inferred with reference to the home position. For example, the diverter 300 may be configured to move to the first position, e.g., a position where fluid is supplied to the mid-level spray-arm assembly 148, after the home position when the pump 210 is cycled (e.g., deactivated and reactivated and/or a speed of the pump 210 is decreased and then increased), and in such embodiments exemplary methods may include inferring that the diverter 300 is in the position where fluid is supplied to the mid-level spray-arm assembly 148 after determining that the diverter 300 is in the home position and after a subsequent pump cycle following the determination that the diverter 300 is in the home position. Thus, at least some exemplary embodiments of the method 400 may include determining the diverter 300 is in the first position after determining the diverter is in the second position at step 440 and after the pump 210 has subsequently deactivated and then reactivated.

In some embodiments, the step 440 of determining whether the diverter 300 is in the second position based on the measured fluid pressure may include determining that the diverter 300 is in the second position when the measured fluid pressure increases, e.g., as illustrated in FIG. 8 at the filter clean mode relative to the upper and/or lower spray arm mode, and/or as may be seen by comparing the fluid level 1001 in FIG. 3 to the fluid level 1001 in FIG. 5.

In some embodiments, the step 440 of determining whether the diverter 300 is in the second position based on the measured fluid pressure may include obtaining at least two pressure values, e.g., a first measured pressure value and a second measured pressure value, which may be obtained with the pressure sensor 260, for example. In such embodiments, determining whether the diverter 300 is in the second position based on the measured fluid pressure may include determining that the diverter 300 is in the second position at the time the second measured pressure value is obtained based on the second measured pressure value being greater than the first measured pressure value.

In various embodiments, the diverter 300 may include two or more outlets, as discussed above. Thus, in some embodiments of the method 400, the first component may be a first spray arm, e.g., lower spray-arm assembly 144, and the step 410 of circulating the fluid may include circulating the fluid through a lower portion 146 of the wash chamber. In such embodiments, the method 400 may further include circulating the fluid through an upper portion 147 of the wash chamber 106 by pumping the fluid from the sump 200 into the wash chamber 106 via a second spray arm, e.g., mid-level spray-arm assembly 148 and/or upper spray assembly 150, when the diverter 300 is in a third position.

As mentioned above, features of multiple embodiments may be combined in various ways to provide additional embodiments. For example, aspects of the foregoing examples may be combined such that additional embodiments of method 400 may include determining the diverter 300 is in the first position after determining the diverter 300 is in the second position and the pump 210 has subsequently deactivated and then reactivated, and may further include determining the diverter 300 is in the third position after determining the diverter 300 is in the first position and the pump 210 has subsequently deactivated and then reactivated.

As described above in the context of FIG. 9, in some embodiments a conduit 264 may be provided. Thus, some embodiments of the method 400 may include flowing a portion of the fluid from the filter cleaning manifold 270 directly to the pressure sensor 260 while cleaning the filter 250. For example, the portion of the fluid may flow directly to the pressure sensor 260 through the conduit 264 extending from the filter cleaning manifold 270 to the pressure sensor 260.

Figure 11:
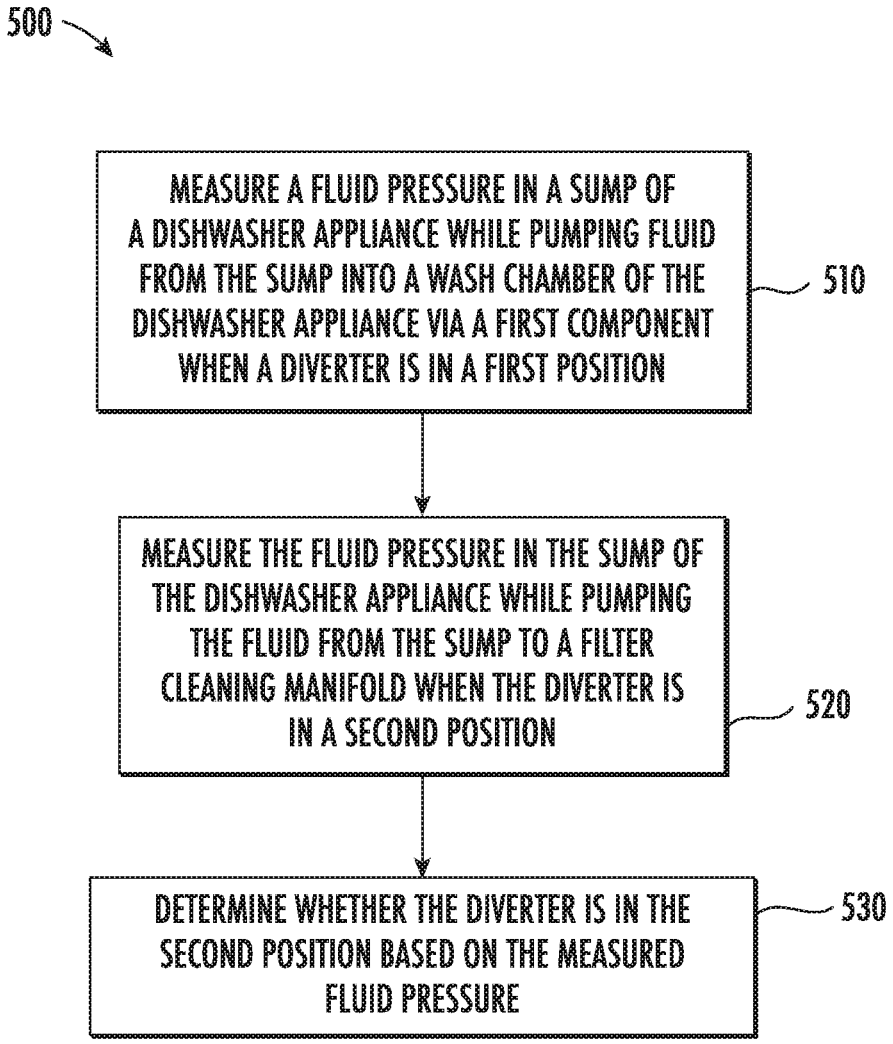
FIG. 11 provides a flowchart illustrating exemplary steps of a method according to one or more additional exemplary embodiments of the present subject matter.

FIG. 11 illustrates an example method 500 of determining a position of a diverter 300 of a fluid circulation system 152 in a dishwasher appliance 100. The method 500 includes a step 510 of measuring a fluid pressure in a sump 200 of the dishwasher appliance 100 while pumping fluid from the sump 200 into a wash chamber 106 of the dishwasher appliance 100 via a first component when the diverter 300 is in a first position. As discussed above with regard to method 400, the first component in step 510 may be, e.g., one or more of the spray assemblies 144, 148, and 150. The method 500 also includes a step 520 of measuring the fluid pressure in the sump 200 of the dishwasher appliance 100 while pumping the fluid from the sump 200 to a filter cleaning manifold 270 when the diverter 300 is in a second position. The method 500 further includes a step 530 of determining whether the diverter 300 is in the second position based on the measured fluid pressure. For example, the step 530 may include, in various embodiments, determining that the diverter is in the second position when the measured fluid pressure increases and/or based on a second measured pressure value being greater than a first measured pressure value.

Figure 12:
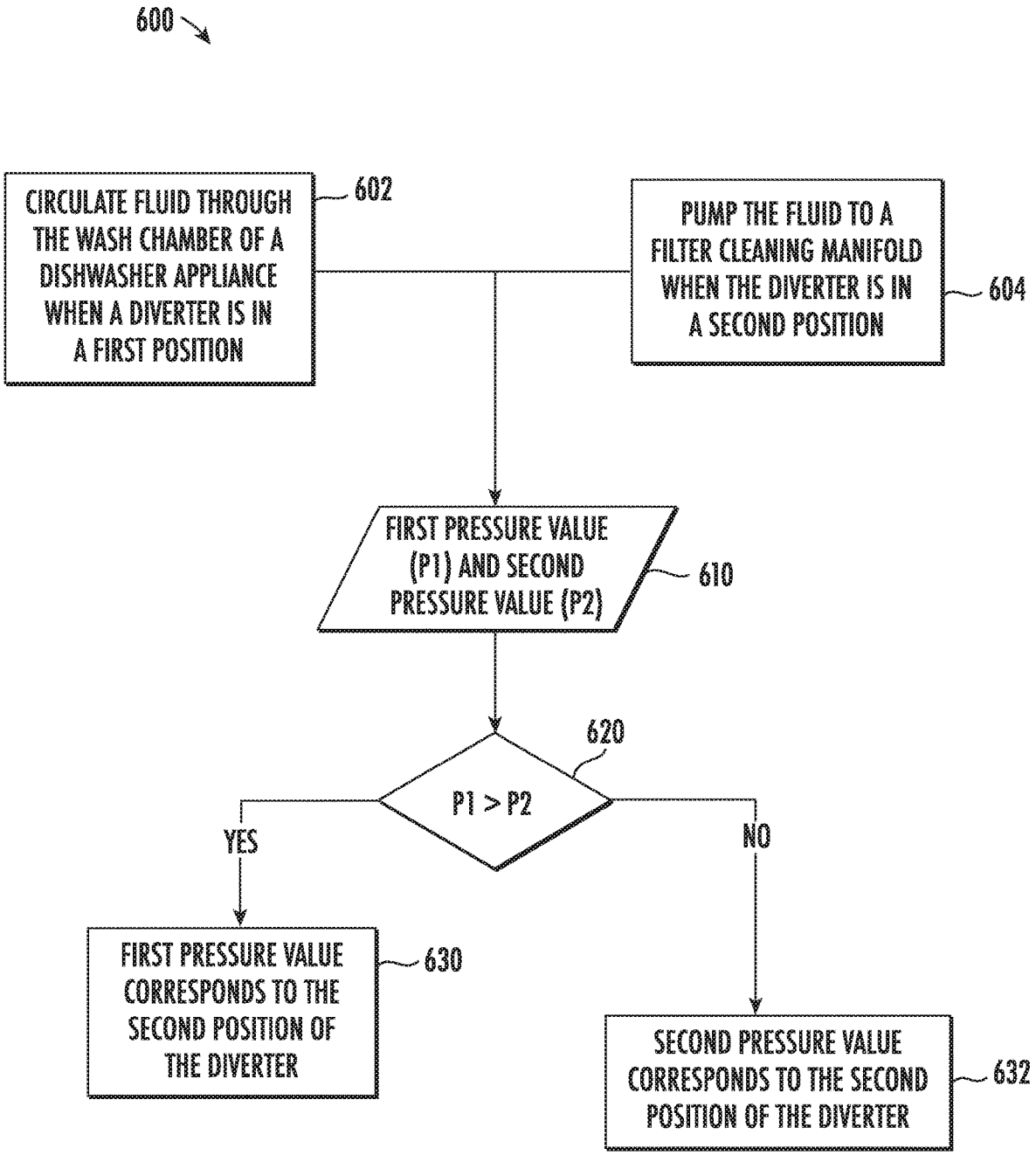
FIG. 12 provides a flowchart illustrating exemplary steps of a method according to one or more further exemplary embodiments of the present subject matter.

FIG. 12 illustrates an additional exemplary method 600 of determining the position of the diverter 300 and/or determining an operation mode of the dishwasher appliance 100 based on measured pressures. For example, the method 600 may include a step 602 of circulating fluid through the wash chamber 106 when the diverter 300 is in a first position and a step 604 of pumping the fluid to a filter cleaning manifold 270 when the diverter 300 is in a second position. Various pressure values, e.g., of fluid pressure within the sump such as lower sump pressure values (e.g., FIG. 8) may be obtained during the steps 602 and 604. For example, as mentioned above, the pressure may be continuously or periodically measured or monitored during the steps 602 and 604, e.g., with pressure sensor 260. Thus, multiple measure pressure values may be obtained, e.g., at least a first pressure value P1 and a second pressure value P2, as indicated at 610 in FIG. 12. The method 600 may further include a comparing step 620, which may include comparing the first pressure value P1 and the second pressure value P2, e.g., determining whether the first pressure value P1 is greater than the second pressure value P2. As shown at step 630 in FIG. 12, when the determination at 620 is positive, e.g., where P1 is greater than P2, the method 600 may include determining that the first pressure value P1 corresponds to the second position of the diverter 300, e.g., that the diverter 300 was in the second position when the first pressure value P1 was obtained. As shown at step 632 in FIG. 12, when the determination at 620 is negative, e.g., where P2 is greater than P1, the method 600 may include determining that the second pressure value P2 corresponds to the second position of the diverter 300, e.g., that the diverter 300 was in the second position when the second pressure value P2 was obtained.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A method of operating a dishwasher appliance, the dishwasher appliance comprising a tub that defines a wash chamber and a sump positioned below the wash chamber to receive fluid from the wash chamber, the method comprising:

circulating fluid through the wash chamber with a fluid circulation system, the fluid circulation system comprising a pump, a filter upstream of the pump, and a diverter downstream of the pump, wherein circulating fluid through the wash chamber comprises pumping fluid from the sump into the wash chamber via a first component when the diverter is in a first position;

cleaning the filter by pumping the fluid from the sump to a filter cleaning manifold when the diverter is in a second position;

measuring a fluid pressure in the sump with a pressure sensor while circulating the fluid and cleaning the filter; and determining whether the diverter is in the second position based on the measured fluid pressure, wherein the diverter is a passive diverter which moves from the first position to the second position when the pump is deactivated after circulating the fluid and then reactivated.

2. The method of claim 1, wherein determining whether the diverter is in the second position based on the measured fluid pressure comprises determining that the diverter is in the second position when the measured fluid pressure increases.

3. The method of claim 1, wherein measuring the fluid pressure in the sump comprises obtaining a first measured pressure value and a second measured pressure value, and wherein determining whether the diverter is in the second position based on the measured fluid pressure comprises determining that the diverter is in the second position at the time the second measured pressure value is obtained when the second measured pressure value is greater than the first measured pressure value.

4. The method of claim 1, further comprising determining the diverter is in the first position after determining the diverter is in the second position and the pump has subsequently deactivated and then reactivated.

5. The method of claim 1, wherein the first component is a first spray arm and circulating the fluid comprises circulating the fluid through a lower portion of the wash chamber, further comprising circulating the fluid through an upper portion of the wash chamber by pumping the fluid from the sump into the wash chamber via a second spray arm when the diverter is in a third position.

6. The method of claim 5, further comprising determining the diverter is in the first position after determining the diverter is in the second position and the pump has subsequently deactivated and then reactivated, and determining the diverter is in the third position after determining the diverter is in the first position and the pump has subsequently deactivated and then reactivated.

7. The method of claim 1, further comprising flowing a portion of the fluid from the filter cleaning manifold directly to the pressure sensor while cleaning the filter.

8. The method of claim 7, wherein the portion of the fluid flows directly to the pressure sensor through a conduit extending from the filter cleaning manifold to the pressure sensor.

9. A method of determining a position of a diverter of a fluid circulation system in a dishwasher appliance, the method comprising:

measuring a fluid pressure in a sump of the dishwasher appliance while pumping fluid from the sump into a wash chamber of the dishwasher appliance via a first component when the diverter is in a first position;

measuring the fluid pressure in the sump of the dishwasher appliance while pumping the fluid from the sump to a filter cleaning manifold when the diverter is in a second position; and determining whether the diverter is in the second position based on the measured fluid pressure, wherein the diverter is a passive diverter which moves from the first position to the second position when the pump is deactivated after circulating the fluid and then reactivated.

10. The method of claim 9, wherein determining whether the diverter is in the second position based on the measured fluid pressure comprises determining that the diverter is in the second position when the measured fluid pressure increases.

11. The method of claim 9, wherein measuring the fluid pressure in the sump while pumping fluid from the sump into the wash chamber comprises obtaining a first measured pressure value, wherein measuring the fluid pressure in the sump while pumping the fluid from the sump to the filter cleaning manifold comprises obtaining a second measured pressure value, and wherein determining whether the diverter is in the second position based on the measured fluid pressure comprises determining that the diverter is in the second position based on the second measured pressure value being greater than the first measured pressure value.

12. The method of claim 9, further comprising determining the diverter is in the first position after determining the diverter is in the second position and the pump has subsequently deactivated and then reactivated.

13. The method of claim 9, wherein the first component is a first spray arm and pumping the fluid into the wash chamber comprises pumping the fluid into a lower portion of the wash chamber, further comprising pumping the fluid into an upper portion of the wash chamber by pumping the fluid from the sump into the wash chamber via a second spray arm when the diverter is in a third position.

14. The method of claim 13, further comprising determining the diverter is in the first position after determining the diverter is in the second position and the pump has subsequently deactivated and then reactivated, and determining the diverter is in the third position after determining the diverter is in the first position and the pump has subsequently deactivated and then reactivated.

15. The method of claim 9, further comprising flowing a portion of the fluid from the filter cleaning manifold directly to the pressure sensor while pumping the fluid from the sump to the filter cleaning manifold.

16. The method of claim 15, wherein the portion of the fluid flows directly to the pressure sensor through a conduit extending from the filter cleaning manifold to the pressure sensor.

17. The method of claim 1, wherein the pressure sensor is positioned outside of the sump and proximate a bottom end of a sidewall of the filter.

18. The method of claim 17, further comprising flowing a portion of the fluid from the filter cleaning manifold directly to the pressure sensor while cleaning the filter, wherein the portion of the fluid flows directly to the pressure sensor through a conduit extending from the filter cleaning manifold to the pressure sensor.

19. The method of claim 9, wherein the measured fluid pressure is measured with a pressure sensor positioned outside of the sump.

20. The method of claim 19, further comprising flowing a portion of the fluid from the filter cleaning manifold directly to the pressure sensor when the diverter is in the second position, wherein the portion of the fluid flows directly to the pressure sensor through a conduit extending from the filter cleaning manifold to the pressure sensor.

* * * * *